US006741721B2

(12) United States Patent
Fukawatase et al.

(10) Patent No.: US 6,741,721 B2
(45) Date of Patent: May 25, 2004

(54) INFORMING APPARATUS FOR MOBILE COMMUNICATION APPARATUS

(75) Inventors: Toshifumi Fukawatase, Tamaho-machi (JP); Kenichi Ooki, Tamaho-machi (JP); Yutaka Mae, Tamaho-machi (JP)

(73) Assignee: Minebea Co., Ltd., Nagano-ken (JP)

( * ) Notice: Subject to any disclaimer, the term of this patent is extended or adjusted under 35 U.S.C. 154(b) by 206 days.

(21) Appl. No.: 09/789,767

(22) Filed: Feb. 22, 2001

(65) Prior Publication Data

US 2002/0114486 A1 Aug. 22, 2002

(51) Int. Cl.[7] ..... H04R 25/00
(52) U.S. Cl. ..... 381/401; 381/396; 381/421
(58) Field of Search ..... 381/396, 400, 381/401, 150, 190, 191, 402, 406, 412, 421; 379/52; 340/388.1, 388.2, 407.1

(56) References Cited

U.S. PATENT DOCUMENTS

| | | | | |
|---|---|---|---|---|
| 6,373,362 | B1 * | 4/2002 | Kim | 335/222 |
| 6,487,300 | B1 * | 11/2002 | Lee et al. | 381/396 |
| 6,553,125 | B2 * | 4/2003 | Kobayashi et al. | 381/396 |
| 2001/0017922 | A1 * | 8/2001 | Kim | 381/150 |

FOREIGN PATENT DOCUMENTS

| | | |
|---|---|---|
| JP | 61-124183 | 8/1986 |
| JP | 5-85192 | 11/1993 |
| JP | 11-19590 | 1/1999 |
| JP | 11-70365 | 3/1999 |
| JP | 11-197601 | 7/1999 |

* cited by examiner

*Primary Examiner*—Curtis Kuntz
*Assistant Examiner*—Brian Ensey
(74) *Attorney, Agent, or Firm*—McDermott, Will & Emery

(57) ABSTRACT

An informing apparatus for a mobile communication apparatus has two magnetic gaps A, B formed in a magnetic circuit, in which voice coils are set respectively. A first vibrant part includes one voice coil connected to a diaphragm, and a second vibrant part includes another voice coil connected, via supporters, to a casing set outside the magnetic circuit, the supporters and the magnetic circuit. A sound receiving function and/or a call-tone receiving function, which is performed with a sound signal and/or a call-tone signal sent to the voice coil 8 in the first vibrant part, and a silent mode call-reception informing function, which is performed with a call-reception signal sent to the voice coil in the second vibrant part whereby the supporters and the magnetic circuit are vibrated thereby making the mobile communication apparatus itself resonate, work independently.

13 Claims, 3 Drawing Sheets

INFORMING APPARATUS FOR MOBILE COMMUNICATION APPARATUS

BACKGROUND OF THE INVENTION

The present invention relates to a call-reception informing apparatus for a mobile communication apparatus such as a mobile phone or a radio communication device.

A communication apparatus like a mobile phone has a function to inform call-reception by means of sound and/or vibration.

As a typical example of such an informing function, for example, "a vibrator and a mobile communication apparatus using the same" are disclosed in Japanese Patent Laid-open No. Hei 11-19590.

As shown in FIG. 1 of the publication, this mobile communication apparatus includes a fixed part 2, a first vibrant body 10 which comprises a permanent magnet 7 and yokes 8, 9, is supported by a first spring 6 attached to the fixed part 2 and has a resonance frequency $f_o$, and a second vibrant body 14 which is supported by a second spring 12 attached to the fixed part 2 and has a coil 13 set in a magnetic gap 11 formed by the yokes 8, 9. The apparatus performs an informing function with vibration when a signal of the frequency $f_o$ is sent to the coil 13 and works as a receiving speaker or a call-tone receiver when a voice band signal or a call-tone signal is sent to the coil 13.

As a similar mobile communication apparatus, an electromagnetic induction type converter described in Japanese Utility Model Laid-open No. Hei 05-85192 or the like is known.

The mobile communication apparatus includes a magnetic gap formed in each magnetic circuit comprising a magnet made of a permanent magnet (hereinafter referred to as magnet) and a yoke, and a voice coil with one end fixed to a diaphragm in the magnetic gap, and generates sound or vibration depending on frequency of input signals sent to the voice coil. Because of that, one vibrant body (for sound) needs to have enough rigidity so as not to resonate with another vibrant body (for vibration). Therefore, the resonance frequency of one vibrant body (for sound) needs to be set higher than that of another vibrant body (for vibration). This inconveniently restricts the lower limit of reproduction frequency for the receiving speaker.

When the vibration for informing call-reception is generated, the voice coil of one vibrant body (for sound) is inputted with a signal of a resonance frequency (near 100 Hz) of another vibrant body (for vibration), whereby another vibrant body (for vibration) is vibrated. However, since the rigidity of the one vibrant body (for sound) is not high enough, sound wave (incidental sound) is undesiredly generated, which makes "silent mode" (mode of informing only with vibration) fail to deserve its name.

The mobile phone equipped with a vibration motor and a buzzer separately can generate vibration and sound wave simultaneously for the call-reception informing function. However, since conventional technology uses only one voice coil, the function has not been performed effectively enough.

SUMMARY OF THE INVENTION

In view of such a current situation, the present invention seeks to provide a mobile communication apparatus with an informing apparatus which includes two magnetic gaps formed in a magnetic circuit including a magnet made of a permanent magnet and a yoke, and a voice coil respectively set in each magnetic gap. One voice coil is used for sound or call-tone, and another voice coil for vibration. This enables the mobile communication apparatus to be used in the silent mode without limitation on resonance frequency.

Another objective of the present invention is to provide the informing apparatus of the mobile communication apparatus with a function to control the vibration level by vibrating a weight (vibrated body) using the voice coil for vibration, and by selecting the size of the weight.

To achieve the objective, the invention according to a first aspect of the present invention constitutes an informing apparatus for a mobile communication apparatus, which is characterized in that:

- two magnetic gaps are formed in a magnetic circuit of internal magnet type or external magnet type;
- a voice coil is respectively set in each magnetic gap;
- a first vibrant part includes one voice coil connected to a diaphragm; and
- a second vibrant part includes another voice coil connected via supporters to a casing set outside the magnetic circuit, the supporters and the magnetic circuit; wherein
- a sound receiving function and/or a call-tone receiving function which operates with a sound signal and/or a call-tone signal sent to the voice coil in the first vibrant part, and a call-reception informing function which makes the supporters and the magnetic circuit vibrate with a call-reception signal sent to the voice coil in the second vibrant part whereby the mobile communication apparatus itself resonates are adapted to work independently of each other.

The invention according to a second aspect of the present invention constitutes an informing apparatus for a mobile communication apparatus, which is characterized in that:

- two magnetic gaps are formed in a magnetic circuit of internal magnet type or external magnet type;
- a voice coil is set in each magnetic gap;
- a first vibrant part includes one voice coil connected to a diaphragm; and
- a second vibrant part includes another voice coil fixed to a supporting spring set in the magnetic circuit and having a weight at each of both ends thereof, the magnetic circuit having the supporting spring, and the weights; wherein
- a sound receiving function and/or a call-tone receiving function which operates with a sound signal and/or a call-tone signal sent to the voice coil in the first vibrant part, and a call-reception informing function which makes the weights and the magnetic circuit vibrate with a call-reception signal sent to the voice coil in the second vibrant part whereby the mobile communication apparatus itself resonates are adapted to work independently of each other.

DETAILED DESCRIPTION OF THE INVENTION

A preferred embodiment of the informing apparatus for the mobile communication apparatus of the present invention is explained below with reference to attached figures.

Although the present invention refers to a mobile phone or a small radio communication device as the mobile communication apparatus, the embodiment of the invention is not limited thereto as long as it can inform call-reception by means of sound and/or vibration.

Figure 1:
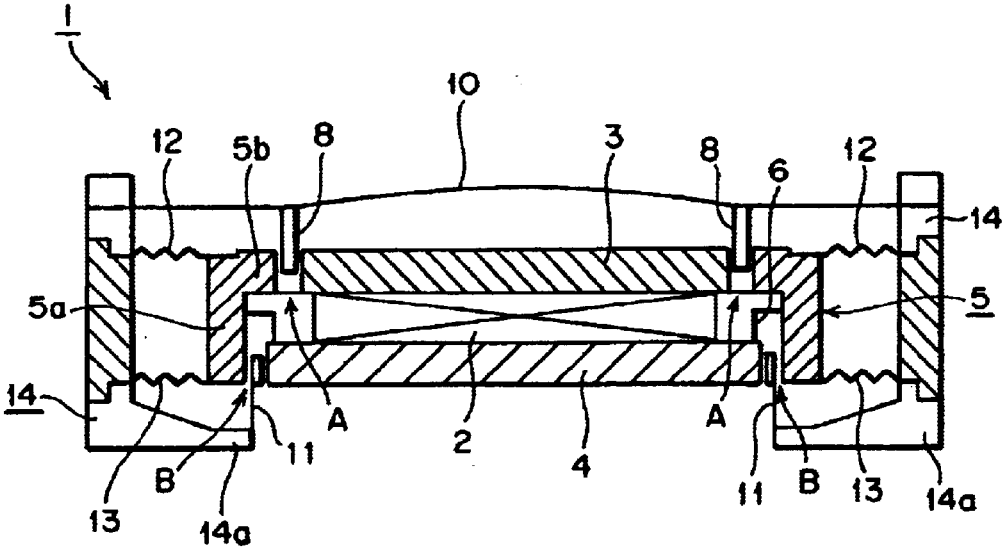
FIG. 1 is a schematic illustration showing an embodiment of an informing apparatus of the present invention.
Figure 2:
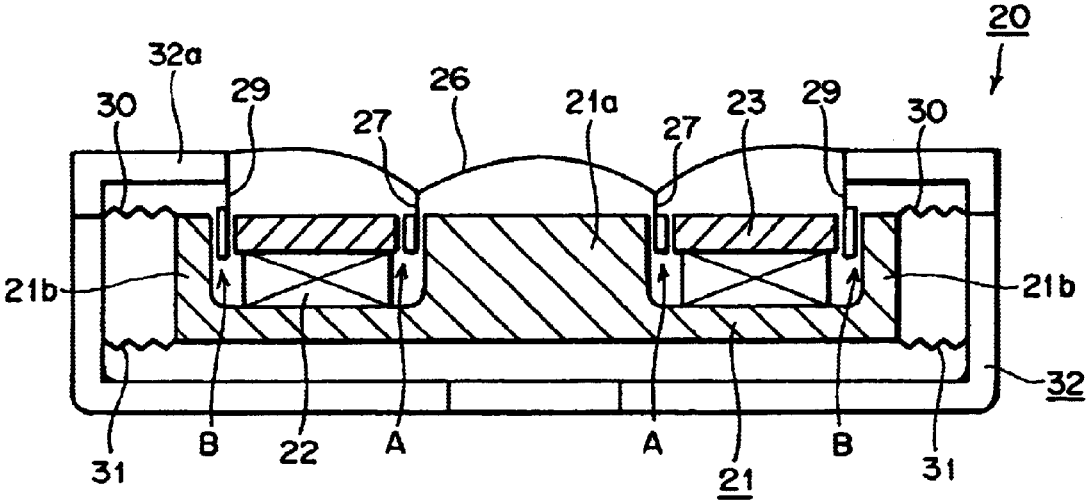
FIG. 2 is a schematic illustration showing another embodiment of an informing apparatus of the present invention.

The magnetic circuit of the present invention is concretely either internal magnet type or external magnet type. FIG. 1 shows an internal magnet type and FIG. 2 shows an external magnet type.

An informing apparatus 1 shown in FIG. 1 includes an internal magnet type magnetic circuit formed in such a manner that a disk-shaped magnet 2 with a desired thickness and diameter is sandwiched by a top plate 3 and a bottom plate 4 both similarly with a desired thickness and diameter, and that a side plate 5, in which the inner diameter of a cylinder 5*a* is slightly larger than the outer diameter of the bottom plate 4 and the inner diameter of a ring-shaped flange 5*b* horizontally protruding inward at the upper end part is slightly larger than the outer diameter of the top plate 3, is set on the bottom plate 4 via a ring-shaped guide 6.

In the internal magnet type magnetic circuit constructed as previously described, magnetic gaps A and B are formed respectively, between the outer circumferential face of the top plate 3 and the ring-shaped flange 5*a* of the side plate 5, and between the outer circumferential face of the bottom plate 4 and the inner circumferential face of the lower end part of the side plate 5.

In such a magnetic circuit, the first vibrant part performing a sound receiving function and/or a call-tone receiving function includes a voice coil 8 in the magnetic gap A of the magnetic circuit, one end of the voice coil 8 being fixed to a diaphragm 10 whose outer circumferential part is fixed to the upper end part of a ring-shaped casing 14 connected via a pair of upper and lower supporters 12, 13 to the outer circumferential part of the side plate 5. The sound receiving function and/or the call-tone reception function works with the diaphragm 10 operating with a sound signal and/or a call-tone signal sent to the voice coil 8.

On the other hand, the second vibrant part performing a call-reception informing function in the silent mode includes a voice coil 11 in the magnetic gap B of the magnetic circuit, one end of the voice coil 11 being fixed to a flange part 14*a* set at the lower end part of the ring-shaped casing 14. When a call-reception signal is sent to the voice coil 11, the second vibrant part, which has the magnetic circuit comprising the magnet 2, the top plate 3 and the bottom plate 4 and connected to the casing 14 via the supporters 12 and 13, vibrates and simultaneously the mobile communication apparatus itself resonates. This way the call-reception informing function works in the silent mode The supporters 12, 13 are basically doughnut-shaped when vertically viewed. They may have a notch at a desired part in order to regulate their resonance frequency and may be butterfly damper shaped. In any case, the supporters are produced by punching out rubber, elastomer, bakelite board, phosphor bronze or cloth or by molding synthetic resin. The material for the supporters can be selected optionally depending on the informing apparatus they are applied to. Various means such as bonding, crimping and screwing can be employed for fixing supporters 12, 13 to the casing 14 without particular limitation.

As the diaphragm in the first vibrant part, metals such as aluminum, titanium, duralumin and the like, resin films such as polypropylene (PP), polyethylene terephthalate (PET), polyimide (PI), polyamide (PA) and the like, and natural materials such as pulp and the like can be used. The resin film is preferably used for a microspeaker.

An informing apparatus 20 shown in FIG. 2 includes a magnetic circuit formed in such a manner that a ring-shaped magnet 22 with a desired thickness and diameter is set on a bottom plate 21 having a pole 21*a* integrally formed at the central part of its top face and a side plate 21*b* protruding in the same direction as the pole 21*a* at the outer rim part, and that a ring-shaped top plate 23 with a desired diameter is set on the top face of the magnet 22.

This external magnet type magnetic circuit includes a first magnetic gap A formed between the pole 21*a* and the inner circumferential face of the ring-shaped top plate 23 and a second magnetic gap B formed between the inner circumferential face of the side plate 21*b* and the outer circumferential face of the top plate 23.

A voice coil 27 integrally formed at the back face of a diaphragm 26 is set in the first magnetic gap A to constitute a first vibrant part which performs a sound-receiving function and/or a call-tone receiving function.

The outer circumferential part of the diaphragm 26 is fixed to a flange 32*a* set at the top end part of an almost blind-cylinder-shaped casing 32 connected via a pair of upper and lower supporters 30, 31 to the outer side of the side plate 21*b* constituting the magnetic circuit.

On the other hand, a second vibrant part which performs a call-reception informing function in the silent mode includes a voice coil 29 set in the second magnetic gap B with one end thereof attached to the casing 32 which is connected via a pair of the supporters 30, 31 to the side plate 21*b*, the supporters 30 and 31, and the magnetic circuit comprising the bottom plate 21, the magnet 22 and the top plate 23 and connected to the supporters 30, 31.

Figure 3:
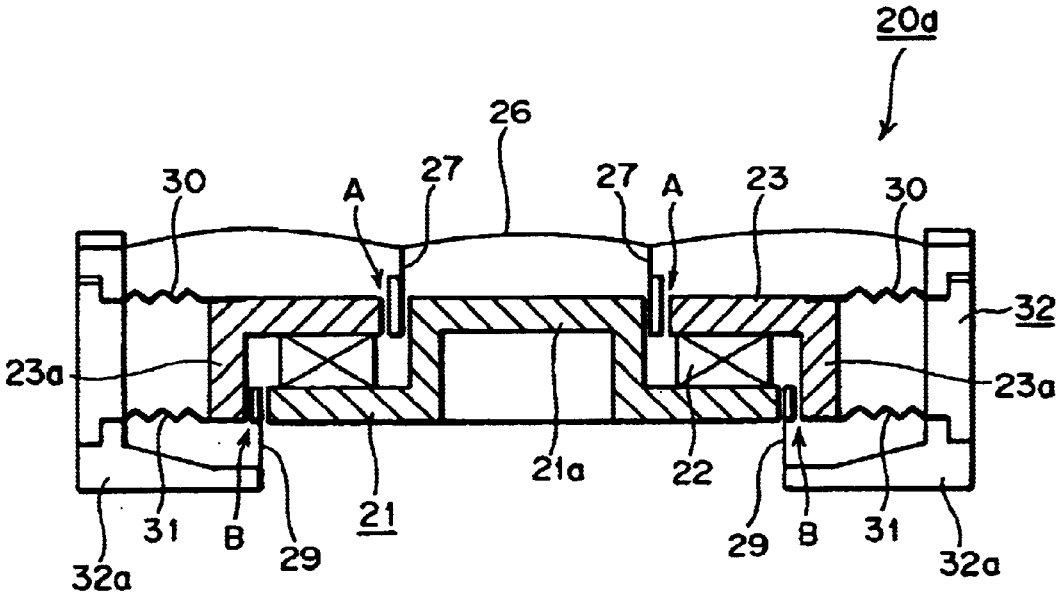
FIG. 3 is a schematic illustration showing a further embodiment of an informing apparatus of the present invention.

An informing apparatus 20*a* shown in FIG. 3 is one variation of the external magnet type informing apparatus 20 shown in FIG. 2. While the informing apparatus 20 has the side plate 21*b* formed integrally and extending upward along the outer circumference of the bottom plate 21, the informing apparatus 20*a* has a side plate 23*a* extending downward along the outer circumference of a top plate 23 and includes a first magnetic gap A formed between a pole 21*a* and the inner circumferential face of the ring-shaped top plate 23, and a second magnetic gap B formed between the inner circumferential face of the side plate 23*a* and the outer circumferential face of the bottom plate 21.

In the informing apparatus 20*a*, the outer circumferential part of a diaphragm 26 is fixed to the top end part of a casing 32, and one end of a voice coil 29 positioned in the magnetic gap B is fixed to a flange part 32*a* formed at the bottom part of the cylindrical casing 32. FIG. 2 and FIG. 3 share a common numeral for an item identically named.

Figure 4:
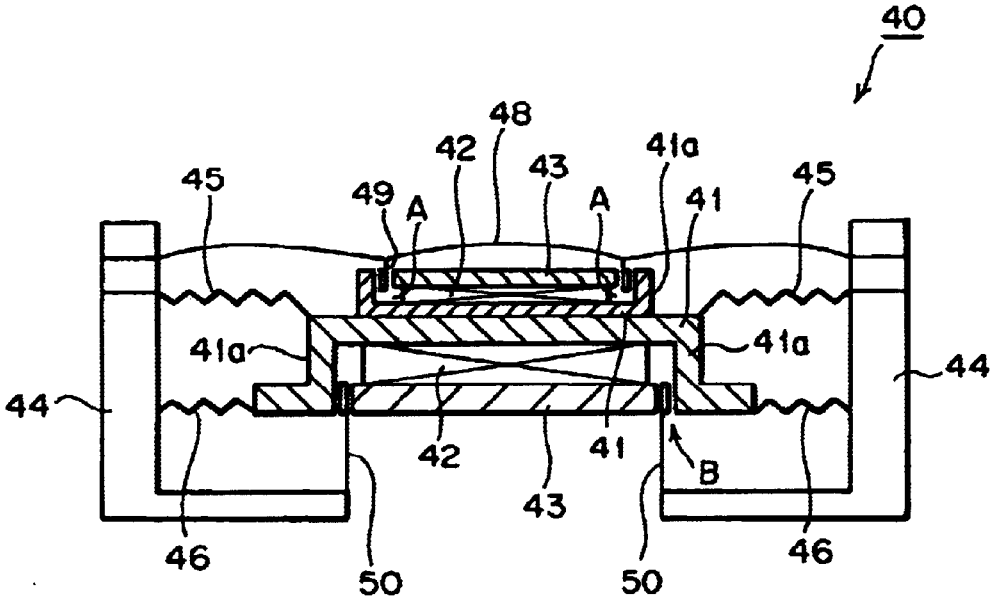
FIG. 4 is a schematic illustration showing an another form of an informing apparatus shown in FIG. 3.

An informing apparatus 40 shown in FIG. 4 includes a pair of driving parts having a different dimension from each other. A smaller driving part in which a disk-shaped magnet 42 with a desired thickness and diameter is set on a bottom plate 41 having a side plate 41*a* formed in a ring-shape integrally at the outer circumferential part and a ring-shaped top plate 43 is set at the top of the magnet 42 so that a magnetic gap A is formed between its outer circumferential part and the inner circumferential face of the side plate 41*a* and a larger driving part which has a magnetic gap B and is oriented upside down relative to the smaller driving part are joined immediately to each other back to back at each of the bottom plate in such a manner that the smaller driving part is positioned above, thereby constituting a magnetic circuit having two magnetic gaps A, B and continuously connected via supporters 45, 46 to a casing 44 set outside the circuit.

A first vibrant part which performs a sound-receiving function and/or a call-tone receiving function is constituted in such a manner that a voice coil 49 attached to the back side of a diaphragm 48 whose outer circumferential part is fixed to the upper end part of the casing 44 is set in the magnetic gap A of the smaller driving part located in the upper portion of the magnetic circuit. A second vibrant part which performs a call-reception informing function in the silent mode is constituted in such a manner that a voice coil 50 one end of which is fixed to the casing 44 is set in the magnetic gap B of the larger driving part located in the lower portion of the magnetic circuit.

The materials used for the supporters and the diaphragms shown in FIG. 2 to FIG. 4 are same as those in the informing apparatus 1 shown in FIG. 1.

Figure 5:
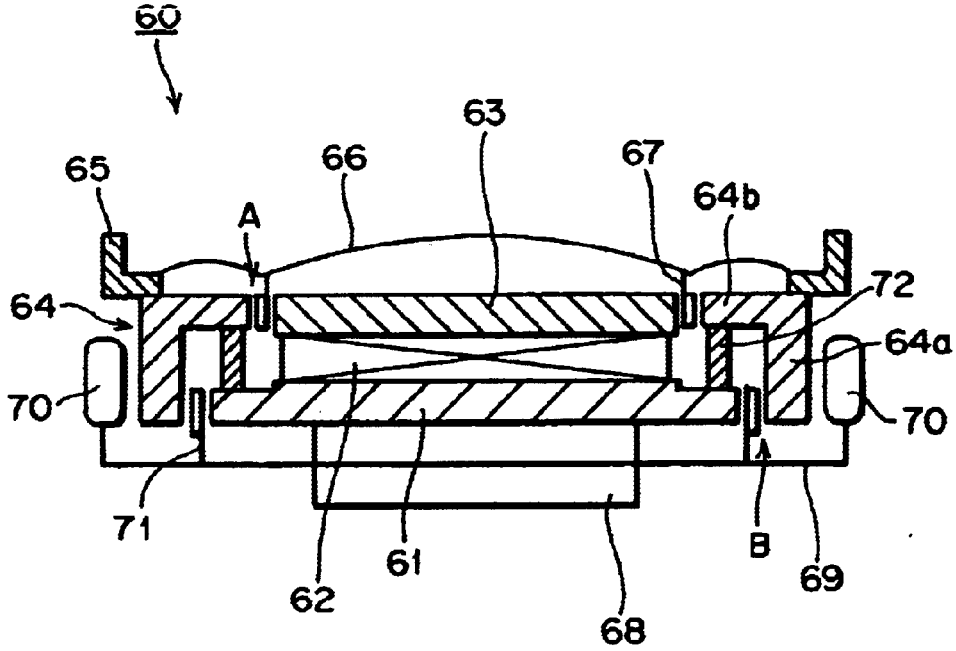
FIG. 5 is a schematic illustration showing a still further embodiment of an informing apparatus of the present invention.
Figure 6:
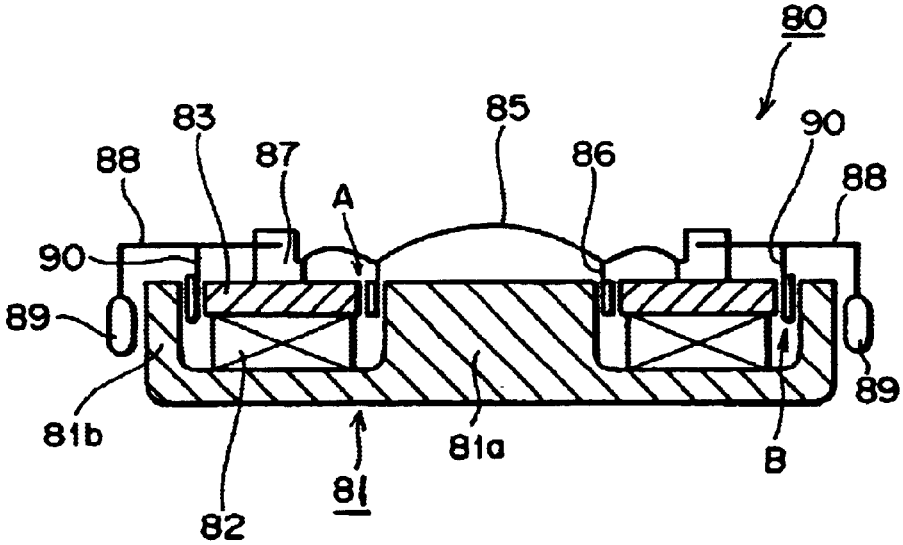
FIG. 6 is a schematic illustration showing a still further embodiment of an informing apparatus of the present invention.

Both of an informing apparatus 60 shown in FIG. 5 and an informing apparatus 80 shown in FIG. 6 represent alternative examples of the informing apparatus of the present invention.

In FIG. 5, similarly to the informing apparatus 1 shown in FIG. 1, the informing apparatus 60 has a magnetic circuit in which a disk-shaped magnet 62 is set on a bottom plate 61 having a desired thickness and diameter, a disk-shaped top plate 63 is set on the top face of the magnet 62, and in which a side plate 64 where a cylinder 64*a* has an inner diameter slightly larger than the outer diameter of a bottom plate 61 and where a ring-shaped flange 64*b* protruding horizontally inward at the upper end part has an inner diameter slightly larger than the outer diameter of the top plate 63 is set outside the top plate 63 and above the bottom plate 61 via a ring-shaped guide 72.

A first vibrant part which performs a sound-receiving function and/or a call-tone receiving function is constituted in such a manner that a voice coil 67 one end of which is attached to a diaphragm 66 fixed to a frame 65 is set in a magnetic gap A formed between the outer circumferential face of the top plate 63 and the inner circumferential face of a flange 64*b* of the side plate 64 of this magnetic circuit.

On the other hand, a second vibrant part which performes a call-reception informing function in the silent mode is constituted in such a manner that a holding part 68 is attached directly to the bottom plate 61, a supporting spring 69 is held by the holding part 68, a weight 70 of desired weight is attached directly to each end of the supporting spring 69 located outside the side plate 64, a voice coil 71 is set in a magnetic gap B formed between the outer circumferential face of the bottom plate 61 and the inner circumferential face of the cylinder 64*a* of the side plate 64, and that one end of the voice coil 71 is connected to the supporting spring 69, whereby the holding part 68, the supporting spring 69, the weight 70 and the voice coil 71 are integrated.

The informing apparatus 60 of such a structure generates sound and/or call-tone on vibration of the diaphragm 66 with a sound signal and/or a call-tone signal sent to the voice coil 67, and the mobile communication apparatus itself resonates to inform call-reception on vibration of the weight 70 with a call-reception signal sent to the voice coil 71.

An informing apparatus 80 shown in FIG. 6 has a first vibrant part which performs a sound-receiving function and/or a call-tone receiving function. The first vibrant part includes a ring-shaped magnet 82 set on a bottom plate 81 having a pole 81*a* integrally formed at the center on its top face and a side plate 81*b* protruding at its outer rim in the same direction as the pole 81*a*, a ring-shaped top plate 83 of a desired diameter set on the top face of the magnet 82, a first magnetic gap A formed between the pole 81*a* and the inner circumferential face of the ring-shaped top plate 83, a second magnetic gap B formed between the inner circumferential face of the side plate 81*b* and the outer circumferential face of the top plate 88, and a voice coil 86 attached to the back face of a diaphragm 85 and set in the first magnetic gap A.

The informing apparatus 80 has a second vibrant part which performs a call-reception informing function in the silent mode. The second vibrant part includes a holding part 87 to support the diaphragm 85 set on the top plate 83, a supporting spring 88 attached to the outer circumferential face of the holding part 87 at opposing position and extending horizontally in such a manner that each end part is located outside the side plate 81*b* constituting the bottom plate 81, a weight 89 of desired size attached to each end part of the supporting spring 88, and a voice coil 90 which is set in the magnetic gap B and one end of which is attached to the supporting spring 88,.

Similarly to the informing apparatus 60, this informing apparatus 80 generates sound and/or call-tone on vibration of the diaphragm 85 with a sound signal and/or a call-tone signal sent to the voice coil 86, and the mobile communication apparatus itself resonates to inform call-reception on vibration of the weight 89 with a call-reception signal for the silent mode sent to the voice coil 90. In any of informing apparatuses above, in principle, a sound receiving and/or call-tone receiving function, and a call-reception informing function work independently. If necessary, it is possible to allow both the sound receiving and/or call-tone receiving function and the call-reception informing function to work ordinarily at the same time. This falls, of course, within the range of the art of the present invention.

The informing apparatus for the mobile communication apparatus of the present invention includes two magnetic gaps formed in a magnetic circuit of internal magnet type or external magnet type, a voice coil respectively set in each magnetic gap, a first vibrant part having one voice coil attached to a diaphragm and performing a sound-receiving function and/or a call-tone receiving function, and a second vibrant part having another voice coil attached to a casing set outside the magnetic circuit via supporters and performing a call-reception informing function in the silent mode where the supporters and the magnetic circuit are vibrated thereby making the mobile communication apparatus resonate. Therefore, the informing apparatus can vibrate with any desired signal input applied to each vibrant part. This makes it possible to choose a frequency to most efficiently cause vibration in accordance with a resonance point which differs depending on the size and structure of mobile communication apparatus.

Especially, since the first vibrant part has no lower limit in reproduction frequency and since the second vibrant part which performs a call-reception informing function has its own dedicated voice coil, there is no possibility at all that the second vibrant part influences the first vibrant part when vibrating. So, the mobile communication apparatus can provide a high quality silent made and the vibration level can be freely selected as well.

In the other informing apparatuses for the communication apparatus of the present invention, in addition to the above results, the magnetic circuit itself can be structured smaller, and the vibration can be intensified by controlling appropriately the size of the weight and/or the length of the supporting spring to support the weight. The control is relatively easy.

What is claimed is:

1. An informing apparatus for a mobile communication apparatus, comprising:

two magnetic gaps formed in a magnetic circuit of internal magnet type or external magnet type;

a voice coil set in each magnetic gap;

a first vibrant part including one voice coil connected to a diaphragm; and a second vibrant part including another voice coil fixed to a supporting spring set in said magnetic circuit and having a weight at each of both ends thereof, said magnetic circuit having said supporting spring, and said weights; wherein a sound receiving function and/or a call-tone receiving function, which is performed by sending a sound signal and/or a call-tone signal to said one voice coil in said first vibrant part, and a call-reception informing function, which is performed by sending a call-reception signal to said another voice coil in said second vibrant part whereby the weights and said magnetic circuit are vibrated thereby making the mobile communication apparatus itself resonate, work independently of each other.

2. An informing apparatus for a mobile communication apparatus, comprising:

two magnetic gaps formed in a magnetic circuit;

a voice coil respectively set in each magnetic gap;

a first vibrant part including one voice coil connected to a diaphragm; and a second vibrant part including another voice coil connected, to a casing set outside said magnetic circuit, said magnetic circuit and at least one supporter connected to the casing for supporting said second vibrant part; wherein a sound receiving function and/or a call-tone receiving function, which is performed by sending a sound signal and/or a call-tone signal to said one voice coil in said first vibrant part, and a call-reception informing function, which is performed by sending a call-reception signal to said another voice coil in said second vibrant part whereby said supporters and said magnetic circuit are vibrated thereby making the mobile communication apparatus itself resonate, work independently of each other, and said magnetic circuit includes:

a disk-shaped magnet sandwiched between a disk-shaped top plate and a bottom plate;

a side plate set outside said top plate and said bottom plate; and a magnetic gap formed in each interval between said side plate and said top plate, and between said side plate and said bottom plate.

3. An informing apparatus for a mobile communication apparatus, comprising:

two magnetic gaps formed in a magnetic circuit;

a voice coil respectively set in each magnetic gap;

a first vibrant part including one voice coil connected to a diaphragm; and a second vibrant part including another voice coil connected to a casing set outside said magnetic circuit, said magnetic circuit and at least one supporter connected to the casing for supporting said second vibrant part; wherein a sound receiving function and/or a call-tone receiving function, which is performed by sending a sound signal and/or a call-tone signal to said one voice coil in said first vibrant part, and a call-reception informing function, which is performed by sending a call-reception signal to said another voice coil in said second vibrant part whereby said supporters and said magnetic circuit are vibrated thereby making the mobile communication apparatus itself resonate, work independently of each other, and said magnetic circuit includes:

a bottom plate having a pole at center and a side plate at an outer rim;

a ring-shaped magnet set on said bottom plate;

a ring-shaped top plate set on a top face of said magnet; and a magnetic gap formed in each interval between said pole and an inner circumferential face of said top plate, and between an outer circumferential face of said top plate and said bottom plate.

4. An informing apparatus for a mobile communication apparatus, comprising:

two magnetic gaps formed in a magnetic circuit;

a voice coil respectively set in each magnetic gap;

a first vibrant part including one voice coil connected to a diaphragm; and a second vibrant part including another voice coil connected to a casing set outside said magnetic circuit, said magnetic circuit and at least one supporter connected to the casing for supporting said second vibrant part; wherein a sound receiving function and/or a call-tone receiving function, which is performed by sending a sound signal and/or a call-tone signal to said one voice coil in said first vibrant part, and a call-reception informing function, which is performed by sending a call-reception signal to said another voice coil in said second vibrant part whereby said supporters and said magnetic circuit are vibrated thereby making the mobile communication apparatus itself resonate, work independently of each other, and said magnetic circuit includes:

a ring-shaped magnet set on a bottom plate having a pole at center, the pole having a recess therein;

a ring-shaped top plate having a side plate at an outer rim and set on a top face of said magnet; and a magnetic gap formed in each interval between said pole and an inner circumferential face of said top plate, and between an inner circumferential face of said side plate and said bottom plate.

5. An informing apparatus for a mobile communication apparatus, comprising:

two magnetic gaps formed in a magnetic circuit;

a voice coil respectively set in each magnetic gap;

a first vibrant part including one voice coil connected to a diaphragm; and a second vibrant part including another voice coil connected to a casing set outside said magnetic circuit, said magnetic circuit and at least one supporter connected to the casing for supporting said second vibrant part; wherein a sound receiving function and/or a call-tone receiving function, which is performed by sending a sound signal and/or a call-tone signal to said one voice coil in said first vibrant part, and a call-reception informing function, which is performed by sending a call-reception signal to said another voice coil in said second vibrant part whereby said supporters and said magnetic circuit are vibrated thereby making the mobile communication apparatus itself resonate, work independently of each other, and said magnetic circuit includes:

a pair of driving parts having a disk-shaped magnet set on a bottom plate; a disk-shaped top plate set on a top face of said magnet; and a magnetic gap formed between an outer circumferential face of said top plate and said bottom plate; wherein said bottom plates of each driving part are joined directly to each other in a back-to-back manner to have two magnetic gaps.

6. An informing apparatus for a mobile communication apparatus, described in claim 1, wherein said magnetic circuit includes:

a disk-shaped magnet sandwiched between a disk-shaped top plate and a bottom plate;

a side plate set outside said top plate and said bottom plate; and a magnetic gap formed in each interval between said side plate and said top plate, and between said side plate and said bottom plate.

7. An informing apparatus for a mobile communication apparatus, described in claim 1, wherein said magnetic circuit includes:

a ring-shaped magnet set on a bottom plate having a pole at center;

a ring-shaped top plate set on a top face of said magnet; and a magnetic gap formed in each interval between said pole and an inner circumferential face of said top plate, and between an outer circumferential face of said top plate and said bottom plate.

8. An informing apparatus for a mobile communication apparatus, described in claim 1, wherein said magnetic circuit includes:

a bottom plate having a pole at center and a side plate at an outer rim;

a ring-shaped magnet set on said bottom plate;

a ring-shaped top plate set on a top face of said magnet; and a magnetic gap formed in each interval between said pole and an inner circumferential face of said top plate, and between an inner circumferential face of said side plate and an outer circumferential face of said top plate.

9. An informing apparatus for a mobile communication apparatus, described in claim 1, wherein said mobile communication apparatus is a mobile phone or a small radio communication device.

10. An informing apparatus for a mobile communication apparatus, described in claim 2, wherein said mobile communication apparatus is a mobile phone or a small radio communication device.

11. An informing apparatus for a mobile communication apparatus, described in claim 3, wherein said mobile communication apparatus is a mobile phone or a small radio communication device.

12. An informing apparatus for a mobile communication apparatus, described in claim 4, wherein said mobile communication apparatus is a mobile phone or a small radio communication device.

13. An informing apparatus for a mobile communication apparatus, described in claim 5, wherein said mobile communication apparatus is a mobile phone or a small radio communication device.

* * * * *